US005987798A

United States Patent [19]

Ronkainen

[11] Patent Number: 5,987,798

[45] Date of Patent: Nov. 23, 1999

[54] BOLT ASSEMBLY FOR ELECTRONIC FIREARM

[75] Inventor: James W. Ronkainen, Hodgenville, Ky.

[73] Assignee: Remington Arms Company, Inc., Madison, N.C.

[21] Appl. No.: 09/013,590

[22] Filed: Jan. 26, 1998

Related U.S. Application Data

[63] Continuation-in-part of application No. 08/713,676, Sep. 17, 1996, which is a continuation-in-part of application No. 08/680,490, Jul. 15, 1996.

[51] Int. Cl.[6] ..... F41A 19/00

[52] U.S. Cl. ..... 42/84; 42/16

[58] Field of Search ..... 42/84, 16, 17; 89/28.05

[56] References Cited

U.S. PATENT DOCUMENTS

| | | | |
|---|---|---|---|
| 337,872 | 3/1886 | Russell | 42/84 |
| 1,349,675 | 8/1920 | Johnson | 42/16 |
| 2,957,391 | 10/1960 | Lovercheck | 89/28.05 |
| 3,208,181 | 9/1965 | Calhoun et al. | 42/84 |
| 3,255,547 | 6/1966 | Gregory, Jr. . | |
| 3,299,812 | 1/1967 | Suh et al. | 42/84 |
| 3,613,282 | 10/1971 | Ramsay . | |
| 3,650,174 | 3/1972 | Nelsen . | |

*Primary Examiner*—Charles T. Jordan
*Assistant Examiner*—Denise Buckley
*Attorney, Agent, or Firm*—Huntley & Associates

[57] ABSTRACT

Bolt mechanism for an electronic firearm adapted to eliminate rearward axial motion of the bolt plug with respect to the bolt body on closing the bolt assembly.

8 Claims, 6 Drawing Sheets

BOLT ASSEMBLY FOR ELECTRONIC FIREARM

CROSS-REFERENCE TO RELATED APPLICATION

This is a Continuation-in-Part of co-pending application Ser. No. 08/713,676, filed Sep. 17, 1996, which is a Continuation-in-Part of application Ser. No. 08/680,490, filed Jul. 15, 1996.

BACKGROUND OF THE INVENTION

This invention relates to firearms and more particularly to electronic firearms. Specifically, the present invention relates to a bolt assembly adapted to fire electrically activated ammunition from an electronic firearm.

In electronic firearms, it is desirable to prevent leakage of gasses associated with the discharge of ammunition within the chamber of the firearm. In previously disclosed electronic firearms and in previously disclosed percussion firearms, gas leakage can be caused by the violation of the primer contact of a round of ammunition within the chamber of the firearm. Such violation occurs, especially in bolt action firearms, when the bolt assembly is closed on a round of ammunition within the chamber. If the firing pin protrudes too far, it may dislodge the primer contact of the round when the bolt assembly is closed and then locked. If the firing pin does not protrude far enough, it will not be in contact with the primer when the bolt assembly is closed and then locked. Accordingly, it is important to provide a means of controlling the protrusion of the firing pin when the firearm is closed, and especially in the case of bolt action firearms, when the bolt assembly is rotated from the closed position to the closed and locked position.

Previous bolt assemblies, upon rotation from the closed to the closed and locked position, were configured so that such rotation resulted in rearward motion of the firing pin with respect to the bolt face at the front of the bolt assembly. Such rearward axial motion was the result of the relative rearward motion of the bolt plug, which did not rotate, with respect to the bolt body. Because the firing pin was supported by the bolt plug, it protruded forward from the front of the bolt body, and when the bolt was closed, could puncture or dislodge the primer contact in a chambered round of ammunition prior to the rotation of the bolt into the closed and locked position. Furthermore, the rearward motion of the firing pin and bolt plug could leave the primer and the round unsupported and could result in gas leakage upon activation of the round.

In an electronic firearm having a round of electrically activated ammunition within its chamber, upon activation of the round, gasses are generated and can escape between the electrical primer contact, insulator, and primer cup of the round. Typically, the leaking gasses expand rearward and can damage the firing pin, its coating, the bolt face, or in extreme cases, the firearm itself. Recent ammunition design provides primers that will seal at maximum operating pressures and above, provided that the primer's electrical contact is properly supported by the firearm's firing pin during firing. Accordingly, there is a need for a means for maintaining contact between the tip of the firing pin and the primer contact at the rear of a round of ammunition within the chamber of the firearm. In addition, in bolt action electronic firearms, there is a need for a means of maintaining such contact during rotation of the bolt from the closed to the closed and locked position without subjecting the round of ammunition to unnecessary forces that can dislodge a primer contact from a round of ammunition and increase the likelihood of gas leakage. There is also a need for a means of providing support to a round of ammunition within the chamber of a gun to limit deformation and rearward extrusion of the primer contact in the rear of the round of ammunition during activation of the round. Such deformation and extrusion can lead to gas leakage.

SUMMARY OF THE INVENTION

The present invention provides an improved bolt assembly which minimizes the possibility of gas leakage in an electronic firearm, and satisfies the needs noted above.

Specifically, the present invention provides a bolt assembly for use in an electronic firearm adapted to fire electrically activated ammunition, the bolt assembly positioned within a receiver behind and substantially aligned with a barrel, the bolt assembly being adapted to move axially between at least a rearward open position and a forward closed position within the receiver, the bolt assembly being further adapted to rotate between at least a locked position and an unlocked position when in the forward closed position, the bolt assembly comprising a bolt body, means for rotating the bolt assembly, a firing pin assembly within the bolt body, and means at the front end of the bolt body for retaining the firing pin within the bolt body and means operatively connected to the rear end of the bolt body for retaining the firing pin within the bolt body, the improvement wherein (a) the means operatively connected to the rear end of the bolt body for retaining the firing pin within the bolt body and (b) the bolt body further comprise complementary coupling means adapted to eliminate rearward axial motion of the means operatively connected to the rear of the bolt body with respect to the bolt body upon rotation of the bolt assembly from the closed and unlocked to the closed and locked position.

DETAILED DESCRIPTION OF THE INVENTION

The present invention will be more fully understood by reference to the figures, which illustrate various embodiments of the bolt assembly of the present invention adapted for use in different types of bolt action electronic firearms. Variations and modifications of these embodiments can be substituted without departing from the principles of the invention, as will be evident to those skilled in the art.

Figure 2:
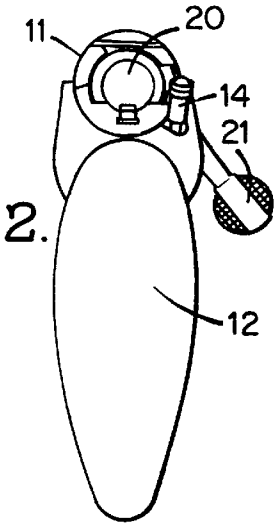
FIG. 2 is a rear elevational view of the firearm of FIG. 1.
Figure 1:
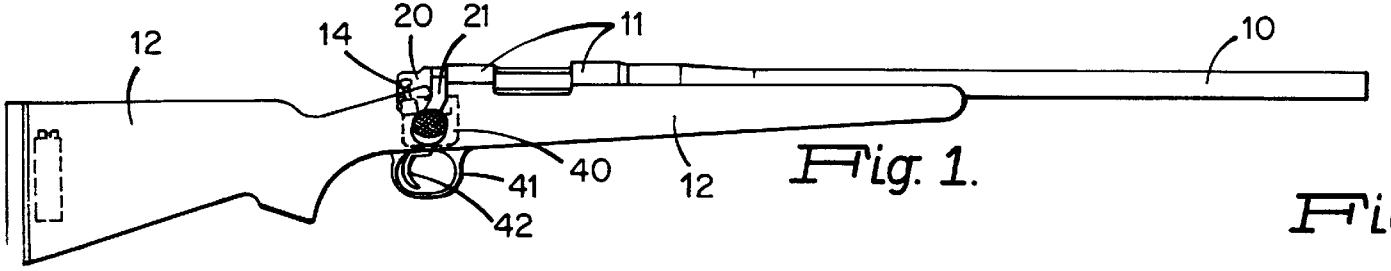
FIG. 1 is a side elevational view of a firearm having a bolt assembly of the present invention.

In FIGS. 1 and 2, a preferred embodiment of an electronic firearm for firing electrically activated ammunition is shown. The bolt assembly of the present invention can be adapted for use in the firearm shown in FIGS. 1 and 2, and other electronic firearms as well. In FIGS. 1 and 2, the firearm has a barrel 10 which is attached to receiver 11, and a stock 12. Both the barrel and receiver are encased in the stock 12. The barrel has a chamber formed in its rear end where it is attached to the receiver. The chamber is connected and adapted to receive ammunition from the receiver. A bolt assembly, generally indicated as 20, is movably positioned within the receiver, behind and substantially aligned with the barrel, and has a handle 21. The barrel 10, receiver 11, bolt assembly 20, and trigger assembly 40 comprise the barrel assembly of the firearm. A safety switch 14, is shown behind the bolt assembly. The bolt assembly is shown in FIGS. 1 and 2 in a closed and locked position.

Figure 3:
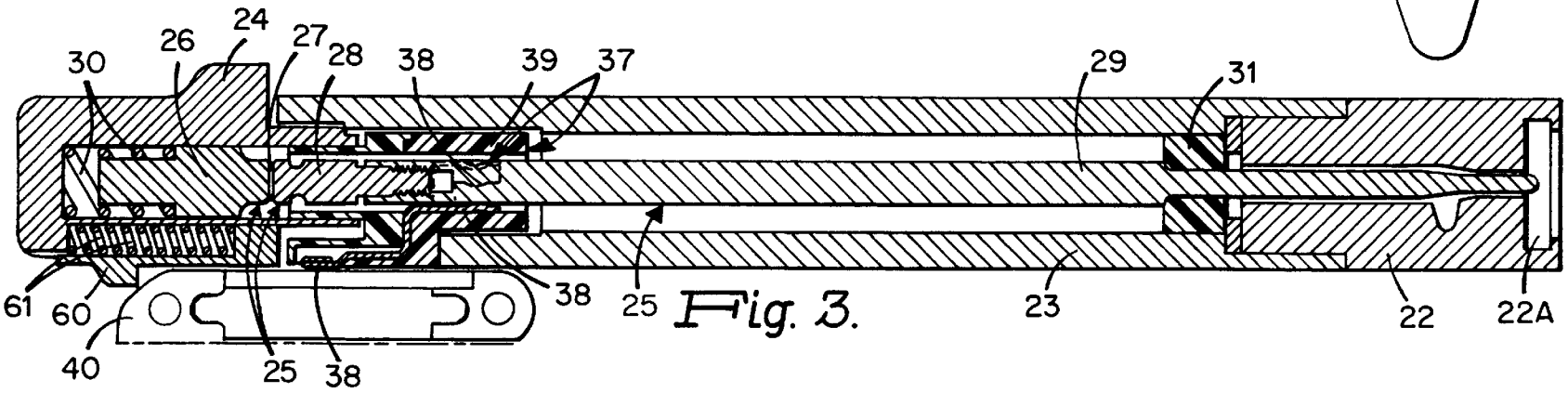
FIG. 3 is a cross-sectional view in elevation of one embodiment of a bolt assembly of the present invention.
Figure 8:
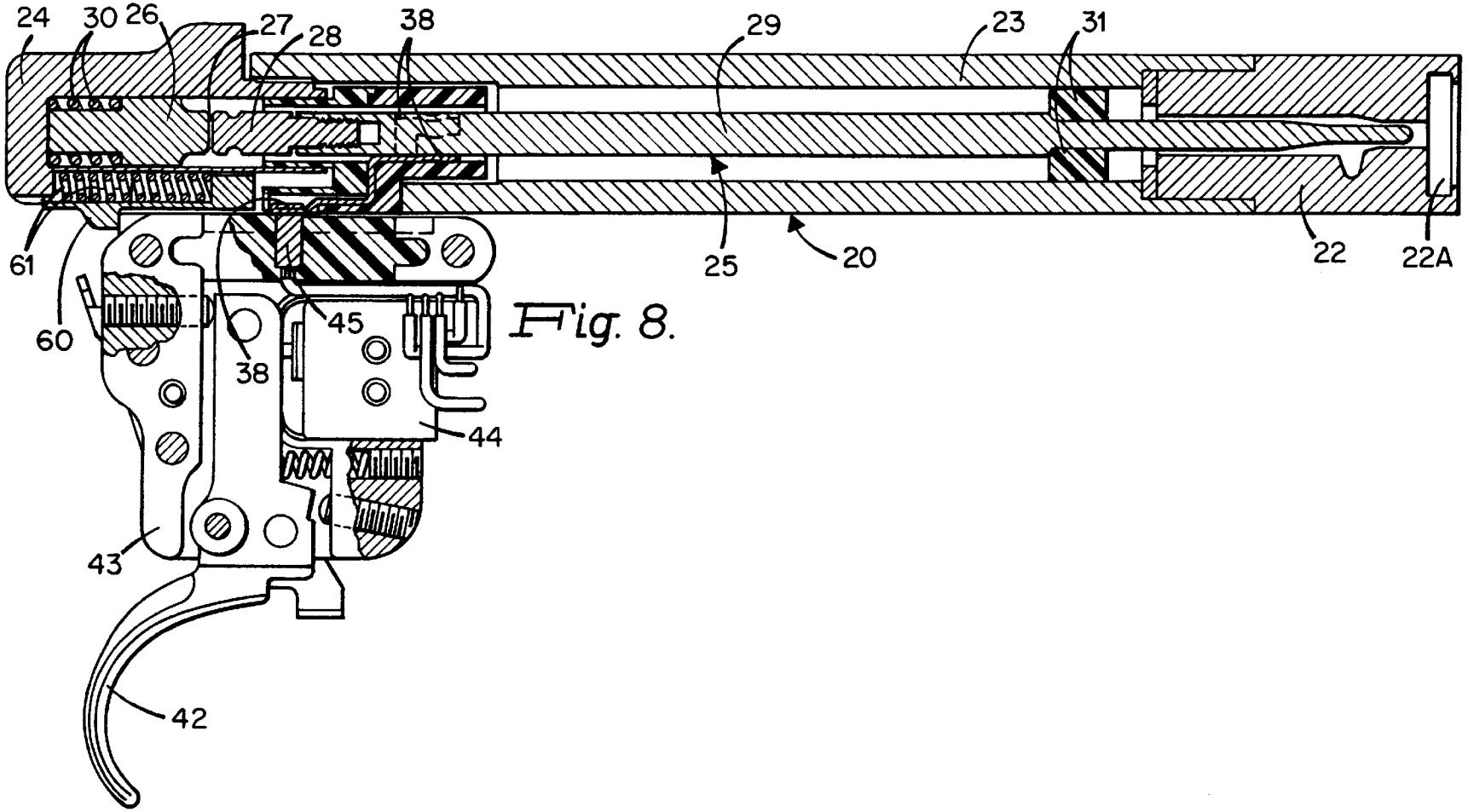
FIG. 8 is a cross sectional view in elevation of the bolt assembly shown in FIG. 3, with the firing pin assembly biased rearward.
Figure 9:
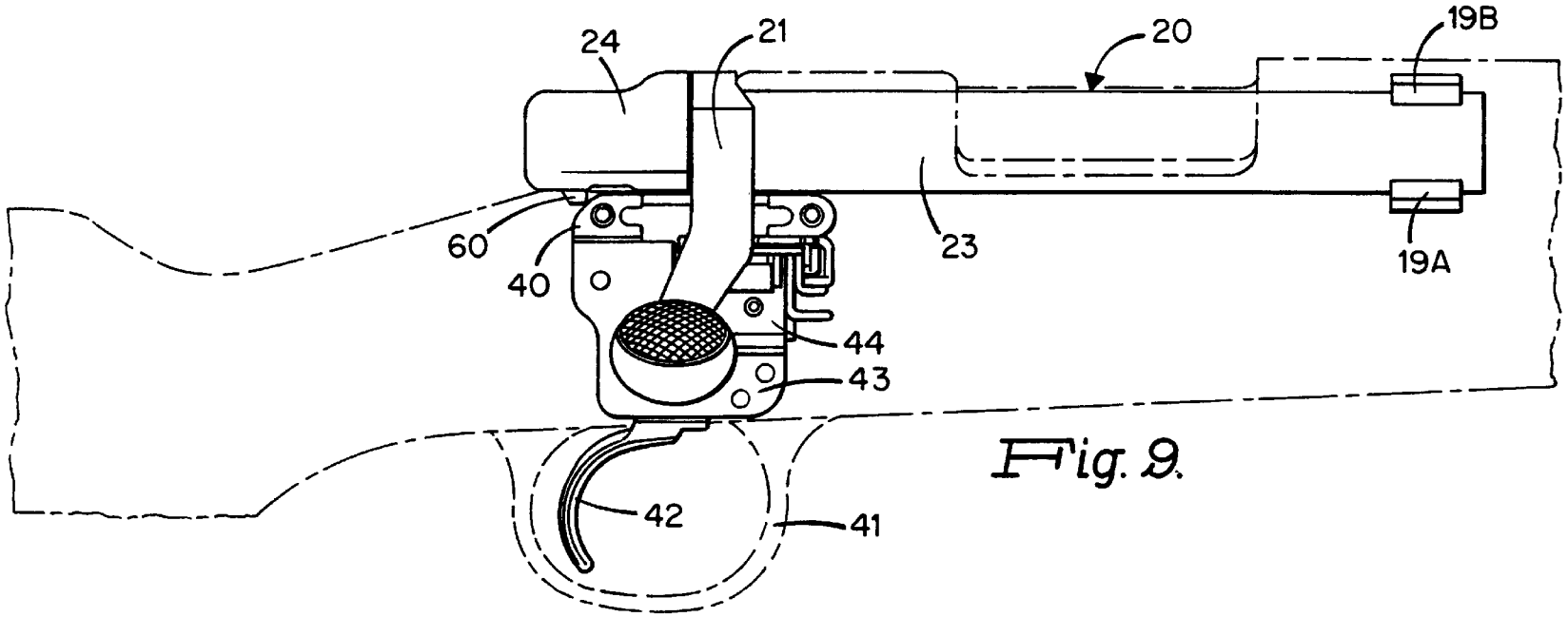
FIG. 9 is a side elevational view of the firearm of FIG. 1, with a portion of the firearm shown in phantom outline for clarity, showing the bolt assembly of the present invention in the closed and locked position.
Figure 10:
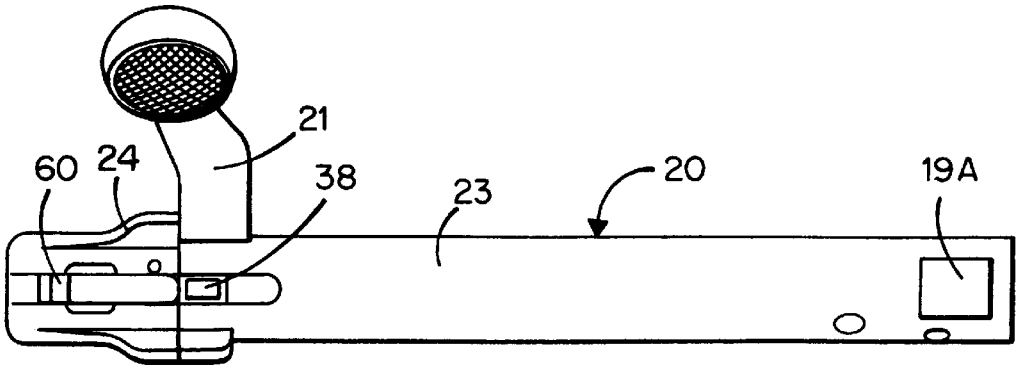
FIG. 10 is a bottom plan view of the bolt assembly shown in FIG. 9.

In the Figures, particularly FIGS. 3 and 8, the bolt assembly 20 has front and rear ends and a bolt head 22 comprising a bolt face 22A at the front end. The bolt assembly can move longitudinally and rotationally within the receiver. More specifically, the bolt assembly can be moved among at least the opened, closed, and closed and locked positions. When the bolt assembly is closed the bolt face is positioned within the rear of the chamber of the barrel. At the rear end of the bolt assembly a handle 21 is provided for moving the bolt to its alternate open, closed, and closed and locked positions. Trigger assembly 40 is located below the receiver in the stock, and includes trigger guard 41 which extends below and beyond the stock, and trigger 42.

The bolt assembly is positioned within the receiver behind and substantially aligned with the barrel. The bolt assembly includes a hollow bolt body 23 operatively connected at its rear end to a means for retaining the firing pin. In the embodiment shown, the means for retaining the firing pin within the bolt body is a hollow bolt plug 24 which is sealed at its rear end.

As shown in FIGS. 11–17, the bolt plug and bolt body comprise complementary coupling means. In FIGS. 11 and 13–16, the complementary mating means comprise a threaded male end on the bolt plug and a threaded female end on the rear of the bolt body. The threads are oriented in a manner to eliminate rearward axial motion of the bolt plug with respect to the bolt body that occurs when the bolt assembly is rotated from the closed to the closed and locked position. For example, in a left handed firearm having a bolt assembly adapted to open by clockwise rotation from the closed and locked to the open position, wherein the bolt body and firing pin are adapted to move independently of the bolt plug when the bolt assembly is rotated, the rear of the bolt body and the front of the bolt plug are provided with complementary male and female coupling means comprising threads having a clockwise orientation. In another example, a right handed firearm having a bolt assembly adapted to open by counter-clockwise rotation, wherein the bolt body and firing pin are adapted to move independently of the bolt plug when the bolt assembly is rotated, the rear of the bolt body and the front of the bolt plug are provided with complementary male and female coupling means comprising threads having a counter-clockwise orientation. In alternate embodiments having complementary threaded coupling means, the bolt plug can comprise a threaded female end and the bolt body a threaded male end.

Figure 12:
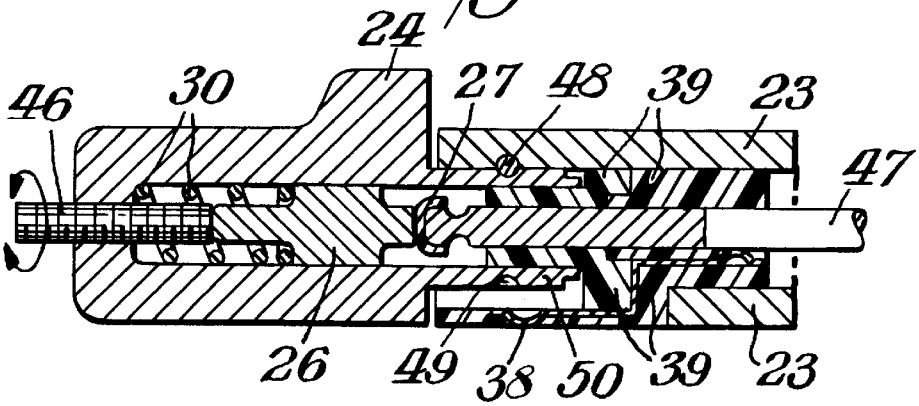
FIG. 12 is a cross-sectional view in elevation of an alternative embodiment of the present invention in which the bolt plug is attached in a fixed axial position.
Figure 17:
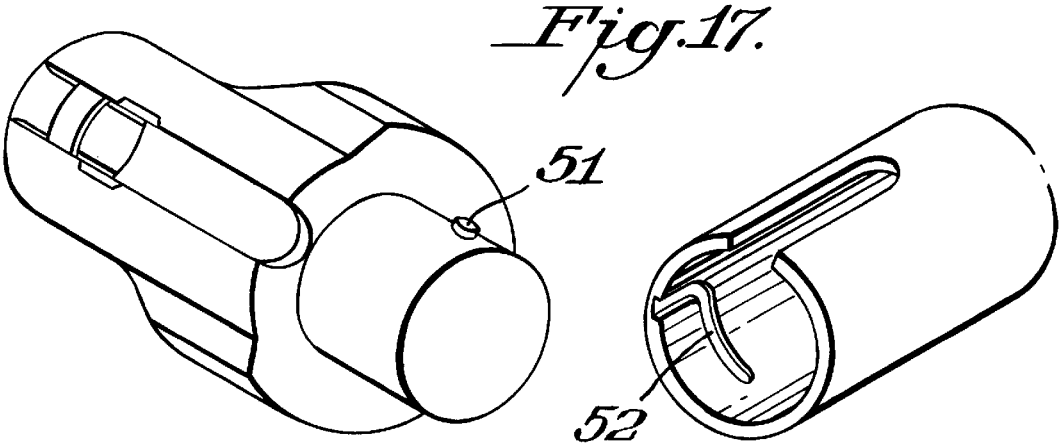
FIG. 17 is a detailed exploded view of an alternate embodiment of a bolt plug and bolt body of the present invention.

In FIGS. 12 and 17, two embodiments of the bolt assembly having alternate complementary coupling means are shown. Both provide a bolt assembly wherein axial movement of the bolt plug with respect to the bolt body resulting from the rotation of the bolt assembly from the closed and unlocked to the closed and locked position is eliminated. FIG. 12, discussed below in greater detail, shows a bolt assembly where the bolt plug and bolt body are cross-pinned together, wherein the cross-pin interacts with a radial groove in the bolt plug to allow the bolt plug to rotate independently of the bolt body. In FIG. 17, the bolt plug comprises a cam follower that interacts with a cam slot formed in the rear of the bolt body. The interaction of the cam follower with the cam slot allows the bolt plug to rotate independently of the bolt body, and also allows for easy disassembly of the bolt assembly. The embodiment of the bolt assembly shown in FIG. 17 is also discussed below in greater detail.

The bolt assembly also includes a preferred means of rotation, which, in the embodiment shown, is a handle 21 on the rear of the bolt assembly which acts as a lever for moving the bolt assembly within the receiver. A preferred movable firing pin assembly 25 that can be used with the present bolt assembly is shown positioned within the bolt assembly and consists of a firing pin plunger 26, a firing pin plunger insulator 27, a firing pin plug 28, and the firing pin itself 29. The firing pin plunger is operatively connected at its forward end to the firing pin plug, and the firing pin plug is operatively connected at its forward end to the firing pin within the bolt body. The firing pin plunger insulator is positioned between the firing pin plunger and the firing pin plug. The firing pin plunger insulator can be a separate component attached to the forward end of the firing pin plunger or the rear of the firing pin, or it can comprise an insulating treatment to the forward end of the firing pin plunger or a treatment to the firing pin plug.

A firing pin spring 30, positioned between the sealed rear end of the bolt plug and the firing pin plunger, biases the firing pin forward by acting on the firing pin plunger. A firing pin shoulder 31 within the front end of the bolt body is positioned to restrict the forward movement of the firing pin, and the rearward movement of the firing pin is limited by the plunger contacting the rear of the bolt plug. FIG. 3 shows the firing pin assembly biased forward to contact a round of ammunition within the chamber of the barrel, while FIG. 8 shows the firing pin assembly biased rearward.

The firing pin plunger, firing pin plunger insulator, firing pin plug, and the firing pin are operatively connected to form the firing pin assembly. In alternate embodiments, the firing pin shoulder can be connected to the firing pin and a part of the firing pin assembly, or it can be positioned within the bolt body. The firing pin assembly is moveable within the bolt assembly, but its range of motion is restricted. Specifically, the firing pin shoulder within the front end of the bolt body is positioned to restrict the forward movement of the firing pin assembly by limiting the forward movement of the firing pin, and the rearward movement of the firing pin assembly is limited by the rear of the firing pin plunger contacting the rear of the bolt plug.

The movable firing pin assembly, shown in FIG. 3 biased forward by firing pin spring 30, ensures contact between the forward conductive tip of the firing pin and the primer at the rear of a round of ammunition within the chamber when the bolt assembly is closed and locked by permitting the firing pin assembly to position itself to compensate for manufacturing variations in ammunition. Rearward travel of the firing pin is limited, as shown in FIG. 8, to provide support for ammunition within the chamber.

In addition, the firing pin plug and the firing pin are adapted to be adjustably connected, permitting individual adjustment of the firing pin in relation to the firing pin plug so that the forward tip of the firing pin is adjustable with respect to the bolt face when the firing pin is biased into its rearwardmost position, as shown in FIG. 8. When in the rearward position, the firing pin assembly thus supports the ammunition during firing and cannot become lodged within the bolt body when it is forced rearward by the ignition of a round of ammunition within the chamber.

Figure 11:
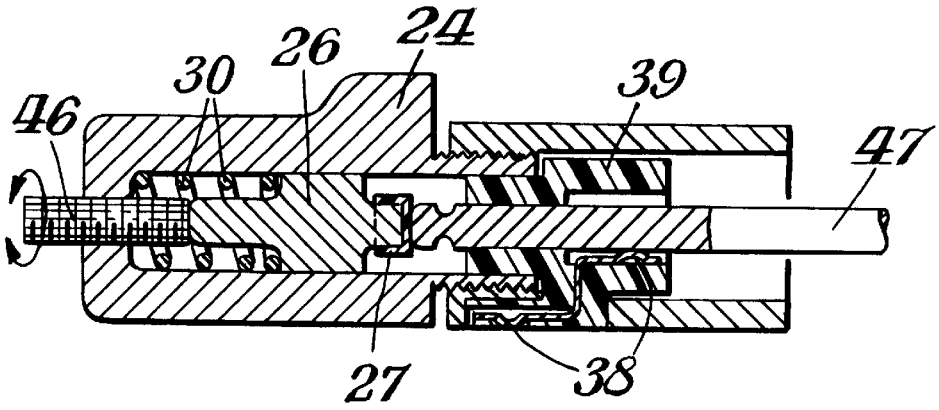
FIG. 11 is a cross-sectional view in elevation of a preferred bolt assembly of the present invention.

In an alternate embodiment of a firing pin assembly that can be used with the present invention, shown in FIG. 11, the firing pin plug can be a threaded adjustment screw, and the bolt plug has a threaded aperture formed in its rear end adapted to receive the adjustment screw. The firing pin spring in the bolt plug biases the firing pin assembly forward by acting on the bolt plug and the firing pin plunger. The adjustment screw contacts the rear of the firing pin plunger to restrict the rearward motion of the firing pin assembly, and can be set so that the forward tip of the firing pin is adjustable with respect to the bolt face when the firing pin is in its rearwardmost position. In this embodiment, shown in FIG. 11, the firing pin plug is attached by a threaded connection, and has a threaded firing pin adjustment screw 46 adapted to fit into a threaded aperture in the rear end of the bolt plug 24, and the firing pin assembly comprises the adjustment screw at its rearward end, the screw operatively connected to a firing pin plunger 26 and a unitary firing pin 47. A firing pin plunger insulator 27 is positioned between the firing pin and the firing pin plunger, and the firing pin assembly is biased forward by the firing pin spring 30 acting on the firing pin plunger and the head of the bolt plug.

The bolt assembly is movably mounted within the receiver of the firearm, and its movement is also limited. On the forward end of the bolt assembly, the bolt head 22 is operatively connected to the front end of the bolt body and has lugs 19A and 19B positioned to engage slots (not shown) formed in the front of the receiver. The slots extend from the rear to the front of the receiver. The engagement between the lugs and the slots guides the bolt assembly, and defines its positions as opened, closed or closed and locked. In addition, when the bolt assembly is closed and locked, the engagement between the lugs and the slots in the front of the receiver prevents rearward motion of the locked bolt assembly.

Figure 6:
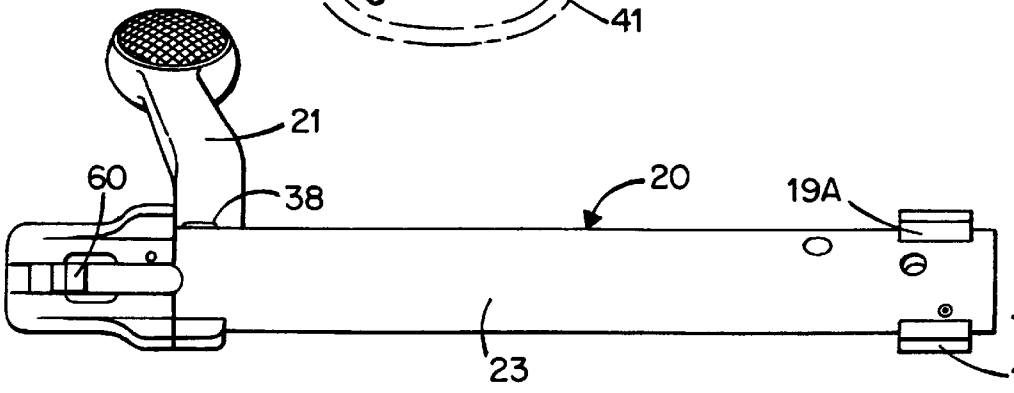
FIG. 6 is a bottom plan view of the bolt assembly shown in FIG. 5.
Figure 7:
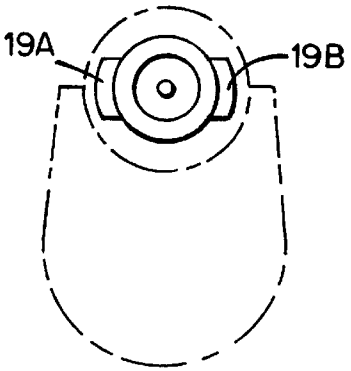
FIG. 7 is a front elevational view of FIG. 5, with the firearm and barrel drawn in phantom.

The forward motion of the bolt assembly is also restricted when it is in the closed and locked position by a bolt plug detent 60 on the bottom of the bolt plug. The bolt plug detent also prevents rotation of the bolt plug when the bolt assembly is in the open position by engaging a notch in the rear of the bolt body, as shown in FIG. 6. The bolt plug detent is biased forward by a bolt plug detent spring 61. The bolt plug detent further restricts the forward movement of the bolt assembly by contacting the trigger housing when the bolt assembly is closed, and restricts forward motion when the bolt is locked. The bolt plug detent and detent spring serve a similar function as a firing pin head and sear in a mechanical firearm, providing resistance and tension to the bolt assembly when it is closed and locked, and preventing the bolt assembly from inadvertently moving from the closed and locked position. The contact between the bolt plug detent and the trigger housing secures the bolt assembly by restricting forward motion of the bolt assembly when it is in the locked position. The interaction of the bolt plug and bolt plug detent provide frictional resistance so that the bolt assembly will not inadvertently open when in the closed and locked position.

In the preferred embodiment of a bolt assembly that can be used with the present invention, a firing pin contact assembly 37 consists of an electrical contact 38 and an insulating housing 39 fixed within the rear of the bolt assembly to rotate and move with the bolt assembly. The firing pin contact is positioned to connect the conductive area at the rear of the firing pin, or, in alternate embodiments not shown, to connect the conductive area at the rear of the firing pin assembly, with an electrical contact on the trigger assembly. The circuit between the firing pin contact and the electrical contact on the trigger assembly can only be completed when the bolt assembly is in the closed and locked position. The firing pin contact and the conductive area at the rear of the firing pin remain connected when the bolt is locked, even as the firing pin is biased forward by the firing pin spring and rearward by a round of ammunition within the chamber of the barrel, thus allowing for dimensional variations in individual rounds of ammunition and ensuring electrical contact between the firing pin and the firing pin contact despite those variations. In addition, the movably mounted bolt assembly ensures that an electrical connection cannot be made between the firing pin and the trigger assembly electrical contact unless the bolt is in the closed and locked position. In an alternate embodiment of the invention, the contact point can be the firing pin plug, which then transmits the current to the ammunition in the chamber.

Figure 4:
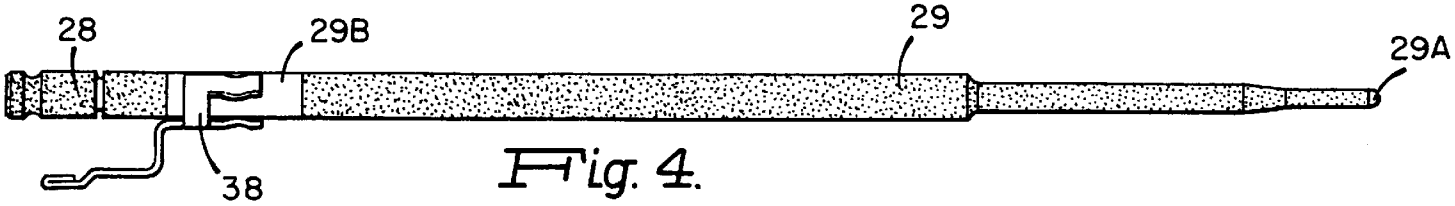
FIG. 4 is a side elevational view of one embodiment of a firing pin assembly that can be used in an embodiment of the bolt assembly of the present invention.
Figure 5:
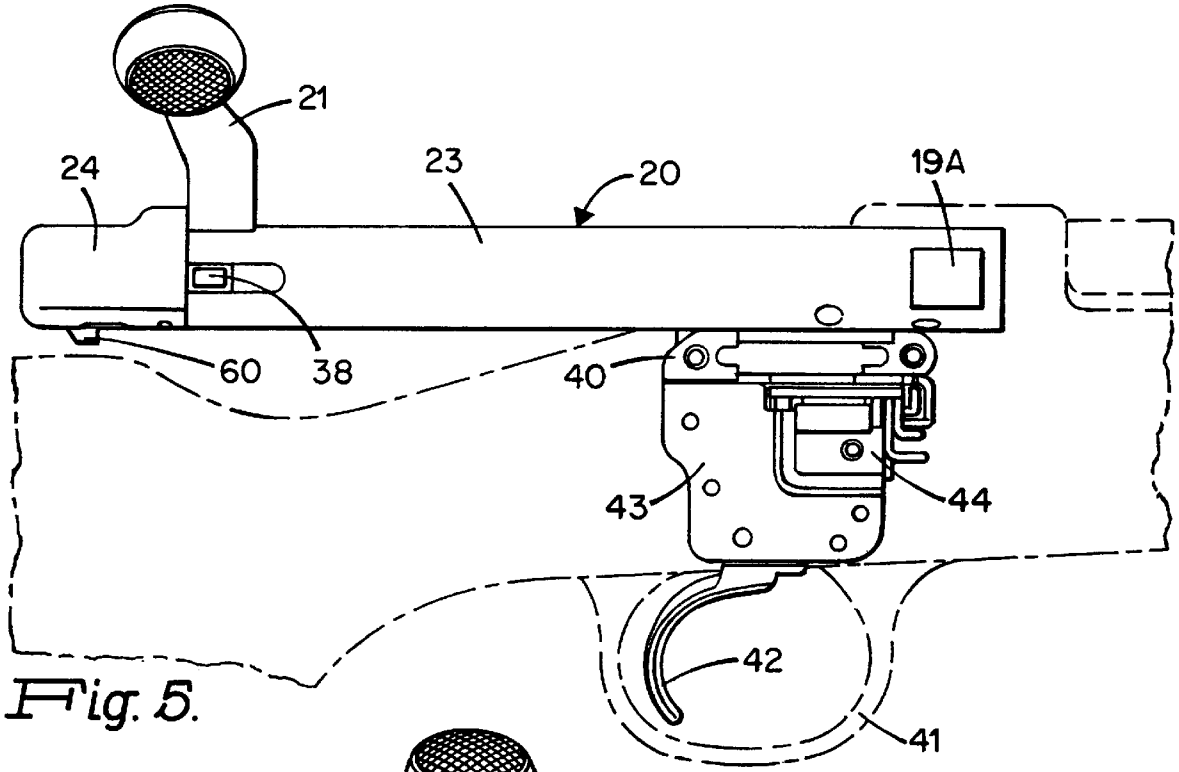
FIG. 5 is a side elevational view of the firearm of FIG. 1, with a portion of the firearm shown in phantom outline for clarity, showing the bolt assembly of the present invention in the open position.

In FIG. 4, the embodiment of the firing pin 29 shown is provided with electrical isolation means to insulate the body of the firing pin. The electrical isolation means is shown as stippling in the figure. The electrical isolation means does not insulate the firing pin at a forward conductive end 29A and rearward conductive area 29B. The forward conductive end is positioned to transmit voltage to a round of ammunition within the chamber of the barrel only when the bolt assembly is in a closed and locked position, and the rearward conductive area is positioned to receive voltage only when the bolt assembly is in the closed and locked position. Within these parameters, the electrical isolation means can vary widely, and can comprise an electrically insulating sleeve around appropriate portions of the firing pin, a surface coating on the firing pin, or a surface modification of the firing pin. Coating materials which can be used for the firing pin include, for example, polymers applied preformed or in situ. Amorphous diamond or ceramics can also be used for an insulating coating on the firing pin. Of the many known ceramics that can be used, those found to be particularly satisfactory include alumina and magnesia stabilized zirconia. Surface modification of the firing pin can also include, for example, ion implantation. Still other coatings or treatments for the firing pin will be evident to those skilled in the art.

The preferred trigger assembly shown in the figures comprises a trigger housing 43 which houses a trigger 42 operatively connected to a switch 44, and a trigger assembly contact 45. The trigger assembly contact is positioned to contact the firing pin contact at the rear end of the bolt assembly, only when the bolt assembly is in the closed and locked position. When the bolt assembly is in the closed and locked position, the trigger assembly contact and the firing pin contact are aligned to form a closed circuit. In firearms having a system control means to control and monitor electronic functions, the system control can be programmed to only permit power to be transmitted through the trigger assembly contact, the firing pin contact, and the firing pin, to a round of ammunition within the chamber.

An alternative embodiment of a bolt assembly comprising the improvement of the present invention is shown in FIG. 12. In that Figure, the bolt plug is attached to the bolt body by a retaining cross-pin 48. The cross-pin interacts with a radial slot 49 in the male portion 50 of the bolt plug. The slot is similar in function to the threads on the male portion of the embodiment of the bolt plug discussed above. The slot extends around the circumference of the male portion of the bolt plug for about from 60 to 360° and is oriented perpendicular to the longitudinal axis of the bolt assembly. The interaction of the radial slot and the cross-pin is designed to permit the bolt body to rotate independently of the bolt plug, and provides a means of eliminating axial movement of the bolt plug with respect to the bolt body when the bolt assembly is rotated from the closed to the closed and locked position. The cross-pin can be retained, for example, by a friction fit or a threaded connection at the far end of the pin. Rotation of the bolt assembly shown in FIG. 12 from the closed to the closed and locked position will result in no axial movement of the bolt plug with respect to the bolt body. When the bolt assembly of FIG. 12 is rotated to the closed and locked position, the bolt plug does not rotate while the bolt body is rotated by action on the bolt handle.

Figure 13:
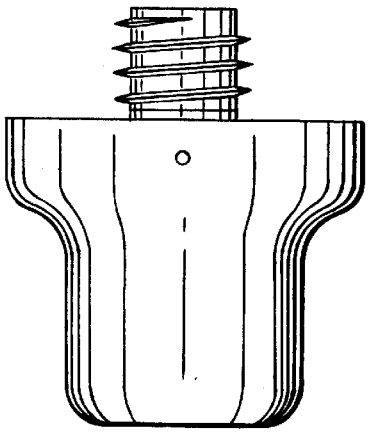
FIG. 13 is a top plan view of a bolt plug of the present invention.
Figure 14:
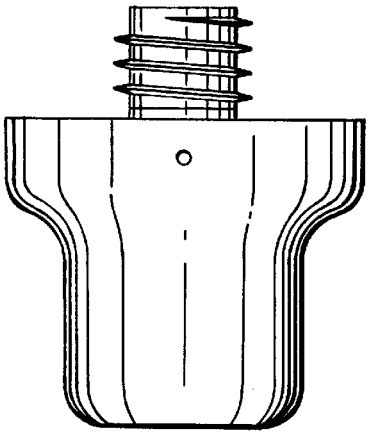
FIG. 14 is a top plan view of an alternate embodiment of a bolt plug of the present invention.
Figure 15:
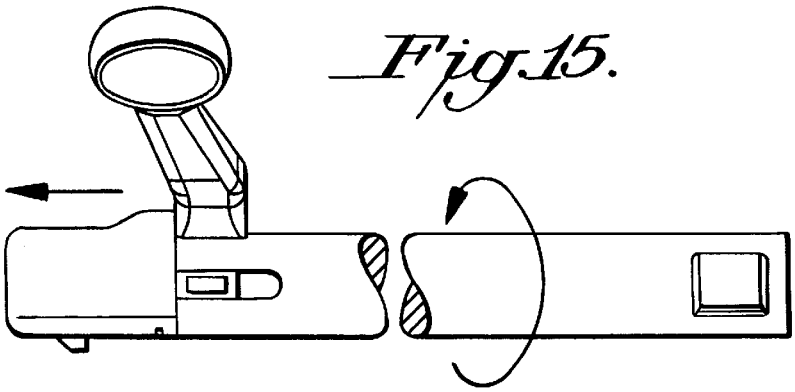
FIG. 15 is a schematic representation of a bolt assembly of the present invention being rotated from the closed and locked to the open position.
Figure 16:
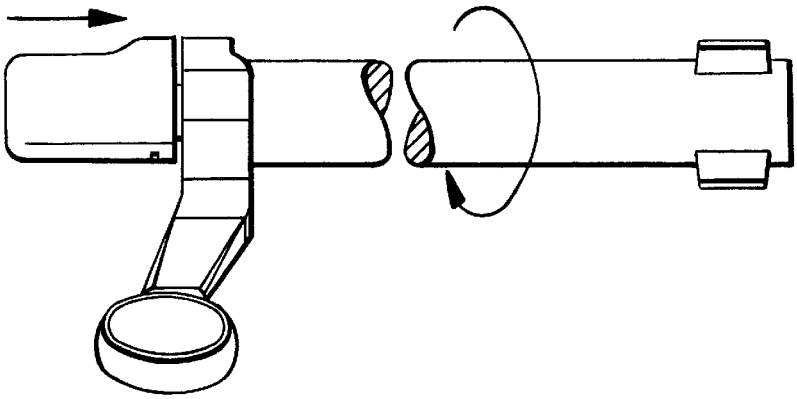
FIG. 16 is a schematic representation of a bolt assembly of the present invention being rotated from the open to the closed and locked position.

In the threaded embodiments of the present invention shown in FIGS. 13 and 14, two bolt plugs are shown. The two bolt bodies to which these bolt plugs would be attached to form left and right handed embodiments of a bolt assembly of the present invention are not shown. Each bolt body would include a complementary coupling means consisting of a female end having threads adapted to interact with the threads of the bolt plugs shown in FIGS. 13 and 14. In FIGS. 15 and 16, a bolt assembly having a threaded bolt plug is shown attached to a threaded bolt body. As can be seen in FIG. 15, rotation of the bolt assembly from the closed and locked to the open position results in rearward axial movement of the bolt plug with respect to the bolt body. Conversely, in FIG. 16, rotation of the bolt assembly from the open position to the closed and locked position results in forward motion of the bolt plug.

The operating principle of the threaded embodiments of the present invention can be summarized as follows. When the bolt is in the closed and locked position, the bolt and the bolt plug are at their closest axial operating positions with respect to each other (the distance between the bottom of the bolt plug plunger hole and the backside of the bolt head is at its minimum value). When the bolt is rotated counter-clockwise to the open position, the bolt and the bolt plug are at their most distant axial operating positions with respect to each other (the distance between the bottom of the bolt plug plunger hole and the backside of the bolt head is at its maximum value). Since the minimum protrusion settings are made with the bolt in the closed and locked position, the rearward axial motion of the bolt plug induced by the threads as the bolt is opened decreases the minimum protrusion of the firing pin.

When the bolt is removed from the rifle, the firing pin's minimum protrusion setting is made by adjusting the firing pin length or firing pin stop screw in the rear of the bolt plug, as shown in FIG. 11. The adjustment is preferably made while biasing the firing pin assembly and plunger assembly rearward. The adjustments should be made with the bolt body and bolt plug simulating their relative position with respect to each other as if they were in the closed and locked. Making the adjustments under these conditions helps to assure that the firing pin's protrusion will be correct for supporting the primer's electrical contact during firing.

The threaded embodiments of the present invention described above comprise left handed and right handed basic embodiments. For example, for firearms adapted to open by clockwise rotation of the bolt assembly, wherein the bolt body and firing pin are adapted to move independently of the means at the rear of the bolt body for retaining the firing pin within the bolt body when the bolt assembly is rotated, and wherein the rear of the bolt body and the front of the means for retaining the firing pin are provided with complementary male and female coupling means, the coupling means comprise threads having a clockwise orientation. Conversely, for similar firearms adapted to open by counter-clockwise rotation of the bolt assembly, the coupling means comprise threads having a counter-clockwise orientation. Thus, for a right handed firearm, a left handed helix is provided on the thread of the bolt plug, and, for a left handed firearm, a right handed helix is provided on the thread of the bolt plug.

A third embodiment of the complementary coupling means of the present invention is shown in FIG. 17. FIG. 17 shows a bolt plug having a cam follower 51, and a bolt body having a cam slot 52 in the rear thereof. The cam follower and cam slot are another possible embodiment of the present complementary coupling means. This embodiment of the present coupling means is shown as a single cam follower and slot for clarity. It is preferred that the bolt plug comprise two cam followers, placed less than about 180° apart, and two corresponding cam slots in the rear of the bolt body. In the embodiment of the present invention shown in FIG. 17, rotation of the bolt assembly from the open to the closed and locked position results in no axial movement of the bolt plug with respect to the bolt body.

Of the embodiments of the invention noted above, the provision of a fixed connection of the bolt plug provides the desired elimination of rearward axial motion. However, it can be more complex to manufacture. Accordingly, the alternative threaded attachment is preferred. Other forms of threads as well as non-threaded means of attaching the bolt to the bolt plug can be used in the present invention. For example, the threads can be conventional single lead or multi-lead, as well as interrupted artillery threads, or helical camming surfaces on both components as opposed to conventional threads.

Still other variations of the present invention will be evident to those skilled in the art.

I claim:

1. A bolt assembly for use in an electronic firearm adapted to fire electrically activated ammunition, the bolt assembly positioned within a receiver behind and substantially aligned with a barrel, the bolt assembly being adapted to move axially between at least a rearward open position and a forward closed position within the receiver, the bolt assembly being further adapted to rotate between at least a locked position and an unlocked position when in the forward closed position, the bolt assembly comprising a bolt body, means for rotating the bolt assembly, a firing pin assembly within the bolt body, and means at the front end of the bolt body for retaining the firing pin within the bolt body and means operatively connected to the rear end of the bolt body for retaining the firing pin within the bolt body, the improvement wherein (a) the means operatively connected to the rear end of the bolt body for retaining the firing pin within the bolt body and (b) the bolt body further comprise complementary coupling means adapted to eliminate rearward axial motion of the means operatively connected to the rear of the bolt body with respect to the bolt body upon rotation of the bolt assembly from the closed and unlocked to the closed and locked position.

2. A firearm of claim 1 wherein the firing pin is urged forward by a spring.

3. A firearm of claim 1 wherein the means operatively connected to the rear end of the bolt body for retaining the firing pin within the bolt body is a bolt plug operatively connected to the rear of the bolt body.

4. A firearm of claim 1 wherein the complementary coupling means are selected from the group consisting of threads, helical camming surfaces, and complementary cam followers and cam cuts.

5. A firearm of claim 1 adapted to open by clockwise rotation of the bolt assembly, wherein the bolt body and firing pin are adapted to move independently of the means operatively connected to the rear of the bolt body for retaining the firing pin within the bolt body when the bolt assembly is rotated, and wherein the rear of the bolt body and the front of the means for retaining the firing pin are provided with complementary male and female coupling means, wherein the coupling means comprise threads having a clockwise orientation.

6. A firearm of claim 1 adapted to open by counter-clockwise rotation of the bolt assembly, wherein the bolt body and firing pin are adapted to move independently of the means operatively connected to the rear of the bolt body for retaining the firing pin within the bolt body when the bolt assembly is rotated, and wherein the rear of the bolt body and the front of the means for retaining the firing pin are provided with complementary male and female coupling means, wherein the coupling means comprise threads having a counter-clockwise orientation.

7. A firearm of claim 1 wherein complementary coupling means are adapted to cause forward axial motion of the means attached to the rear of the bolt body with respect to the bolt body upon rotation of the bolt assembly from the closed and unlocked to the closed and locked position.

8. A firearm of claim 1 wherein the complementary coupling means are adapted to eliminate axial motion of the means attached to the rear of the bolt body with respect to the bolt body upon rotation of the bolt assembly from the closed and unlocked to the closed and locked position.

* * * * *